US006457417B1

(12) United States Patent
Beal

(10) Patent No.: US 6,457,417 B1
(45) **Date of Patent: *Oct. 1, 2002**

(54) METHOD FOR THE MANUFACTURE OF A FRANGIBLE NONSINTERED POWDER-BASED PROJECTILE FOR USE IN GUN AMMUNITION AND PRODUCT OBTAINED THEREBY

(75) Inventor: Harold F. Beal, Rockford, TN (US)

(73) Assignee: Doris Nebel Beal Inter Vivos Patent Trust, Pawley's Island, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/198,823

(22) Filed: Nov. 24, 1998

Related U.S. Application Data

(63) Continuation-in-part of application No. 08/887,774, filed on Jul. 3, 1997, now abandoned, and a continuation-in-part of application No. 08/888,270, filed on Jul. 3, 1997, now abandoned, and a continuation-in-part of application No. 08/842,635, filed on Apr. 16, 1997, now abandoned, and a continuation-in-part of application No. 08/843,450, filed on Apr. 16, 1997, now abandoned, and a continuation-in-part of application No. 08/922,129, filed on Aug. 28, 1997, now Pat. No. 5,847,313.

(51) Int. Cl.[7] ..... F42B 8/14; F42B 8/16; F42B 12/74

(52) U.S. Cl. ..... 102/517

(58) Field of Search ..... 102/517; 419/65

(56) References Cited

U.S. PATENT DOCUMENTS 5,719,352 A * 2/1998 Griffin ..... 102/517
5,847,313 A * 12/1998 Beal ..... 102/516
6,048,379 A * 4/2000 Bray et al. ..... 75/229

* cited by examiner

*Primary Examiner*—Daniel J. Jenkins
(74) *Attorney, Agent, or Firm*—Pitts & Brittian, P.C.

(57) ABSTRACT

A method for the manufacture of heavy metal powder-based frangible projectiles which are relatively easy and inexpensive to manufacture and which exhibit a selectable variety of desirable physical and/or performance properties. The projectiles of the present invention are powder-based, preferably including predominately tungsten powder as a heavy metal, particularly a tungsten powder which includes a predominate portion of finely sized particles. Lighter metal powders, also preferably having a predominate portion of finely sized particles, may be employed in combination with the tungsten to achieve certain desired results. Importantly, the present inventor has found that inclusion of a non-metal matrix powder, also of finely sized particles, in a mixture of a heavy metal powder, such as tungsten powder, and a light metal powder, may be employed in a variety of combinations to produce a projectile which is fully frangible upon striking a target (no ricochet), or which is frangible after either partial or full penetration of a selected target, either a semi-solid (e.g., a gel block) or a solid (e.g., a ¼ inch thick cold rolled steel plate at an angle of about 90 degrees).

40 Claims, 2 Drawing Sheets

METHOD FOR THE MANUFACTURE OF A FRANGIBLE NONSINTERED POWDER-BASED PROJECTILE FOR USE IN GUN AMMUNITION AND PRODUCT OBTAINED THEREBY

RELATED APPLICATIONS

This application is a continuation-in-part of copending applications Ser. No. 08/887,774, filed Jul. 3, 1997 now abandoned, entitled: JACKETED PROJECTILE FOR USE IN SUBSONIC AMMUNITION FOR SMALL-BORE SEMI-AUTOMATIC OR AUTOMATIC WEAPONS AND METHOD FOR MAKING SAME, and Ser. No. 08/888,270, filed Jul. 3, 1997 now abandoned, entitled: PLATED PROJECTILE FOR USE IN SUBSONIC AMMUNITION FOR SMALL-BORE SEMI-AUTOMATIC OR AUTOMATIC WEAPONS AND METHOD FOR MAKING SAME, and Ser. No. 08/842,635, filed Apr. 16, 1997 now abandoned, entitled: AMMUNITION PROJECTILE AND METHOD FOR MAKING SAME, and Ser. No. 08/843,450, filed Apr. 16, 1997 now abandoned, entitled: SMALL BORE FRANGIBLE AMMUNITION PROJECTILE, and Ser. No. 08/922,129, filed Aug. 28, 1997 now U.S. Pat. No. 5,847,313 entitled: PROJECTILE FOR AMMUNITION CARTRIDGE.

FIELD OF INVENTION

This application relates to the manufacture of projectiles for use in small bore gun ammunition and to the projectiles obtained thereby.

BACKGROUND OF INVENTION

In the present application "small-bore" weapons are defined as those weapons of .50 caliber or smaller caliber. The weapon may be a pistol or rifle which includes a rifled barrel.

As used herein, the term "heavy metal" refers to a metal having a density greater than the density of lead and the term "light metal" refers to a metal having a density equal to or less than the density of lead. "Heavy metal-based", as used herein, refers to a product which comprises a significant portion, commonly 50% but can be as low as about 20%, by weight, of a heavy metal.

A projectile for a small bore, i.e., .50 caliber or less, weapon having a rifled barrel, commonly, has heretofore been formed from lead. Lead, and similar soft metal projectiles tend to leave deposits of the metal within the barrel of a weapon as the projectile is propelled along the barrel during firing of the weapon. In such jacketed lead-based projectiles, the trailing end of the lead is not fully covered by the inwardly folded open end of the jacket so that this end of the lead is exposed to the heat and pressure of the burning powder of an ammunition cartridge. Under these circumstances, a portion of the trailing end of the lead is volatilized and eventually condenses in the gun barrel, leaving the barrel fouled with lead. In the prior art, it has been a common practice to encase the lead projectile in a copper jacket to eliminate contact of the lead with the lands and/or inner wall of the weapon barrel, and thereby eliminate the lead deposits within the barrel. These copper jackets are commonly preformed, loaded with a lead core, and thereafter die formed to shape the core and jacket into the desired geometry for the projectile. Lead, being highly malleable, readily deforms to the contour of such dies without fracturing. It has also been practiced to electroplate a copper coating on the exterior surface of a lead core. U.S. Pat. No. 5,597,975 references certain prior copper-plating art and discloses a further plating process for ammunition projectiles. Notably, the cores of these prior art projectiles are not intended to be frangible, hence they generally generate only a channel into or through a target. These projectiles, therefore, have less than desired ability to deliver a stopping force to a moving target, such as an animal.

In known prior art jacketed ammunition projectiles, it has been the intent that the jacket play a material part in the destructive force delivered by the projectile to a target, e.g., the terminal ballistics of the projectile. Accordingly, in the prior art, commonly the jackets are locked onto the core by various mechanical interlocks between the jacket and core, such as channelures and other spatially separated indentations in the core and overlying jacket. In similar manner, heretofore, the prior art teaches that the coating applied to a core for use in forming projectiles should perform a destructive function upon the projectile striking a target. Hollow point type projectiles are of this type. Thus, in some prior art coated or jacketed lead-based projectiles, the jacket or plate coating is scored or otherwise treated to encourage the jacket or coating to fragment upon the projectile striking a target and thereby enhance the "stopping power" (ie., terminal ballistics) of the projectile. Even under these circumstances, the lead core does not materially fragment.

Because of environmental concerns relating to lead, much effort has been expended in the development of projectiles which do not contain lead. This effort has attempted to fabricate a projectile which, when fired from a weapon, responds as nearly like a lead projectile as possible. By this means, there need be little or no change in either existing guns or in the ammunition for these existing guns. Further, there is little or no need to retrain shooters in the use of new and different ammunition. Metals having a density greater than the density of lead generally do not lend themselves to known manufacturing techniques for projectiles for gun ammunition. In part, the expense associated with working with such metals has led to the use of powders of heavy metals. These powders, in general, are difficult to form into shapes. Combinations of various heavy metal powders with lighter metal powders that function as binders for the heavy metal powders have been suggested. Among these combinations it has been suggested that tungsten powder be combined with tin powder and cold-pressed into a projectile, such as in U.S. Pat. No. 5,760,331. Other similar powder combinations have been suggested. Coating or plating the individual powder particles has also been suggested to obtain enhanced packing of the powder particles in a die or to render these individual powder particles non-abrasive. These projectiles suffer various deficiencies including, among others, abrasion of the barrel of the weapon including abrasion and eventual failure of the gas system employed to operate the bolt of an automatic or semi-automatic weapon, inaccuracy of flight to a target, inconsistency of performance from projectile to projectile, high cost of manufacture, incomplete frangibility, etc.

Aside from the reported adverse effects of lead projectiles, in certain shooting situations, such as competitive shooting, sport shooting, and certain warfare and/or law enforcement situations, there has developed a need for a projectile of special properties. For example, accuracy of delivery of the projectile from a weapon to a target has always been a concern of shooters of all classes. Wind effects upon a projectile during its free flight to a target can seriously divert a projectile from its desired flight path, the degree of diversion for a given projectile being a function of the strength and direction of the wind, among other factors. It is known in the art that a heavier projectile offers greater resistance to its flight deviation due to wind effects, but heavier projectiles for a given caliber present other problems. For example, heavier projectiles of a given caliber can be made larger (i.e. longer), but to enable a round of ammunition to be chambered in a given caliber weapon, especially in automatic or semi-automatic guns where the overall length (OAL) of a cartridge must be compatible with the magazine for the gun and the chambering mechanism for the gun, the overall length of the round cannot exceed a given standard value, so that any extra length of a heavier projectile must be disposed within the interior of the case of the round of ammunition. This reduces the space available with the interior of the case which is available to receive gun powder. Less gun powder and a heavier projectile result is a slower moving projectile which, in turn, results in several shooting disadvantages, among which is the fact that the projectile will more easily be adversely affected by wind and static air penetration factors, and the projectile will assume a more pronounced trajectory in its travel to a target and will strike the target at a relatively lower velocity, and with reduced terminal ballistics, for example. Further, spin stability of such projectiles becomes a major factor with respect to the accuracy of the flight of the projectile to its target, in some instances requaireing the barrel of the weapon to be provided with a greater twist value that will ensure spin stability of the projectile.

Alternatively, heavier projectiles of a given caliber can be fabricated from a metal that is heavier than lead. Uranium, tungsten, tantalum and tungsten carbide, for example, have been suggested candidates for heavy projectiles. Herein the term "heavy metal" is intended to include carbides of the metal unless the context of use clearly indicates otherwise. These metals and their carbides are difficult and expensive to fabricate into a projectile, hence, as noted above, powder metallurgy techniques have been suggested for fabricating powdered heavy metals into projectiles. But, these heavier metal powders are hard, abrasive and have a high melting point. In general, in the absence of inordinately high temperatures, such as sintering temperatures, it has not heretofore been known how to form the powder into self-supporting bodies without the use of a softer, less dense binder. Lead, tin, bismuth, iron and other relatively soft metal powders have been suggested as binders. When using a binder, the resulting prior art projectiles have not exhibited full frangibility, particularly where the metal powders are sintered. Further, in these prior art heavy metal/binder compacts, the heavy metal particles remain exposed on the outer surface of a compressed projectile where they are available to erode and damage the bore of a gun barrel. Commonly, the compressed projectile is encased within a soft metal jacket. This jacket serves to isolate the abrasive core of the projectile from the bore in much the same manner that copper-plated lead projectiles serve to prevent the deposit of lead within the bore of a weapon. In those known instances in the prior art where a projectile core is provided with either a jacket or a plated coating, the jacket or plate is solid and only breaks apart under very large force, and its breaking apart is in the form of relatively large strips or chunks of the jacket, as opposed to being fully frangible. The common copper-clad hollow point .22 caliber lead projectile is an example. These prior art cores are solid or essentially solid (e.g., sintered), and perform as if they were a solid metal body.

In certain shooting situations, it is desired that the projectile disintegrate upon striking a semi-solid or solid target, preferably with little or no trace of the projectile remaining on the target. This action primarily is intended to prevent the projectile from ricocheting and endangering a secondary target. Other terminal ballistic features of frangible projectile relate to their destructive capacity. These desired characteristics suggest a powder-based projectile. However, the prior art teaches that to provide a heavy metal powder-based projectile, one must employ inordinately high pressures and/or sintering, to develop appropriate and sufficient bonding between the powder particles as will allow the compacted body to withstand mechanical handling in various manufacturing operations, which will be of uniform density, and which will not disintegrate in flight due to the tremendous centrifugal forces imposed upon the projectile when fired from a rifled gun barrel. Thus, bonding of the particles to one another, such as with a binder or by sintering, is antagonistic to a desired disintegration of this same body upon it striking a target.

In certain law enforcement or warfare circumstances, it is highly desirable that a fired projectile does not ricochet. Ricocheting projectiles endanger both friendly forces and innocent bystanders. In these circumstances, it also is desired that the projectile produce both a "stopping effect" and be lethal.

As noted hereinabove, the known prior art coatings and/or jackets for solid core projectiles teach that the coating or jacket should adhere to the core and only fragment in the form of large chunks or pieces which allegedly increase the destructive power imparted to a target upon it being struck by the projectile. In the instance where the projectile desirably is frangible, the prior art jackets and coatings for cores are not known to disintegrate into relatively minute particulates, hence are less than desirable for use where full frangibility of the projectile is desired or required.

U.S. Pat. No. 5,594,186 (the '186 patent) presents what is represented to be the state of the art in powder metallurgy with reference to the attainment of high density metal products fabricated from metal powder(s). This patent lists "four basic steps to convert a metal powder into a metal component, namely: (1) preparation of a metal powder mixture (said to typically include a metal powder and a lubricant for minimizing "friction between the metal powder and the tooling during compaction, or pressing, step"), (2) pressing the powder mixture in a die to form a green compact, (3) after pressing, subjecting the green compact to an elevated temperature to form a metal component, ie., sintering, and (4) optional secondary operations, such as deburring, to provide the final finished metal component. The strength of a metal component is stated in this patent to be "directly related to the density of the metal component, which in turn is directly related to the density (strength) of the green compact so that considerable effort has been expended in searching for ways to increase the density of both the green compact and the metal component toward 100% of theoretical density. In this regard it is noted that with spherical powder particles one can achieve a theoretical density of between about 88% and 92%. Repressing and sintering of a green compact can raise the theoretical density to about 95%. Warm pressing of the green compact, followed by sintering can achieve about 95% theoretical density. Hot isostatic pressing is said to achieve about 96% of theoretical density. As noted in this patent, each of these processes is expensive and/or time consuming. Justification for the use of such processes in achieving 95%–96% theoretical density of a metal component can only be for special situations and components. In the process of the '186 patent, a metal powder is mixed with a lubricant, loaded into a die and pressed at preferably between about 80,000 to 120,000 psi to form a green compact having a density of 95% to 96%. Thereafter, the green compact is heated to about 300° C. to about 400° C. to volatilize or otherwise drive off the lubricant, followed by heating of the green compact to its sintering temperature.

The metal powder of this patent is characterized as being "substantially linear, acicular particles having a substantially triangular cross section". They are further noted to "have a length of about 0.0006 inches to about 0.20 inch, a base of about 0.002 to about 0.05 inches, and a height of about 0.002 to about 0.05 inches", preferably a length of about 0.01 to about 0.18 inches, a base of about 0.003 to about 0.04 inches, and a height of about 0.004 to about 0.035 inches, and an aspect ratio (length to base ratio) of at least 3 to 1, preferably 5 to 1. Of the three longitudinal surfaces of each particle, one is said to be convex, one is concave and the third is planar or concave. These characteristics of the metal powder particles are stated to provide improved deformation and interlocking between metal particles in the die. Notably, the particles of this patent are not to approach a spheroidal geometry. Production of the required metal powder particles is by means of "a machining or milling process wherein a block or sheet of the metal is fed through a carbide mill or a high-speed steel end mill. The mill has serrated flutes, or inserts, which determine the length of the acicular metal particles. The other dimensional and geometrical properties of the metal particles are determined by the mill speed, metal feed rate, and depth of cut." Thus, the powder particles of this patent have a relatively narrow size distribution, which size is limited to the length, width and height ranges specified. This process is very costly and time consuming, thereby causing the cost of the metal powder to be excessive for other than special applications. Certainly, it is impractical as the source of metal powder particles for use in the fabrication of millions of gun ammunition projectiles which must be of low individual cost. More importantly, the projectile produced as taught in the '186 patent is not fully frangible. Rather it is the objective of the '186 patent to produce a strong projectile, not a frangible projectile. The present inventor has discovered that one can provide a fully frangible projectile by a method which eliminates the time-consuming and costly powder metallurgy techniques taught in this patent.

Aside from his own work with powder-based cores, the present inventor is not aware of any successful fully frangible metal powder-based projectile which can be fire accurately form a small bore weapon. "Fully frangible", as the term is employed with respect to ammunition projectiles, is defined as being disintegratable, upon impact of the projectile with a semi-solid or solid target, into individual particulates, substantially all of which are of a size on the order of the particle size of that powder in the core that has the largest particle size. Most commonly disintegration occurs when a projectile impacts a solid or semi-solid target. In some instances full disintegration may occur over a finite distance after the initial impact with a target, depending upon the medium through which the projectile is traveling. For example, when a projectile of the present invention strikes a gel block, it initially penetrates the gel block for a short distance and then disintegrates within the gel block, the particles of the disintegrated projectile fanning out and traveling in substantially all directions radially in a generally conical pattern from the point of commencement of the disintegration until their kinetic energy is spent. In other instances, such as when the projectile strikes a cold rolled steel metal sheet at an angle of about 90 degrees (ie., the path of the projectile is about normal to the plane of the metal sheet), the projectile commences disintegration upon initially striking the metal sheet, continues disintegration as it passes through the sheet, creating a channel through the sheet and which has a diameter substantially greater than the diameter of the projectile, and then within a few inches after passing through the sheet, the powders of the disintegrated projectile lose all their momentum and fall harmlessly under only the influence of gravity.

It is therefore an object of the present invention to provide a method for the fabrication of frangible projectiles for use in gun ammunition for small bore weapons wherein the individual projectiles may be produced in large numbers and at relatively low individual cost.

It is another object of the present invention to provide a method for the manufacture of frangible projectiles for gun ammunition wherein the method is adaptable to the manufacture of projectiles having selectable performance characteristics.

It is another object of the method of the present invention to provide frangible projectiles for gun ammunition wherein the projectiles may be made to exhibit substantially full penetration of selected targets followed by substantially full frangibility, or to exhibit full frangibility, upon the projectile striking a selected target.

SUMMARY OF INVENTION

In accordance with one aspect of the present invention, there is provided a method for the manufacture of heavy metal powder-based frangible projectiles which are relatively easy and inexpensive to manufacture and which exhibit a selectable variety of desirable physical and/or performance properties.

The projectiles of the present invention are powder-based, preferably including predominately tungsten powder as a heavy metal, particularly a tungsten powder which includes a predominate portion of finely sized particles. Lighter metal powders, also preferably having a predominate portion of finely sized particles, may be employed in combination with the tungsten to achieve certain desired results. Importantly, the present inventor has found that inclusion of a non-metal matrix powder, also of finely sized particles, in a mixture of a heavy metal powder, such as tungsten powder, and a light metal powder, may be employed in a variety of combinations to produce a projectile which is fully frangible upon striking a target (no ricochet), or which is frangible after either partial or full penetration of a selected target, either a semi-solid (e.g., a gel block) or a solid (e.g., a ¼ inch thick cold rolled steel plate at an angle of about 90 degrees).

DETAILED DESCRIPTION OF INVENTION

Figure 1:
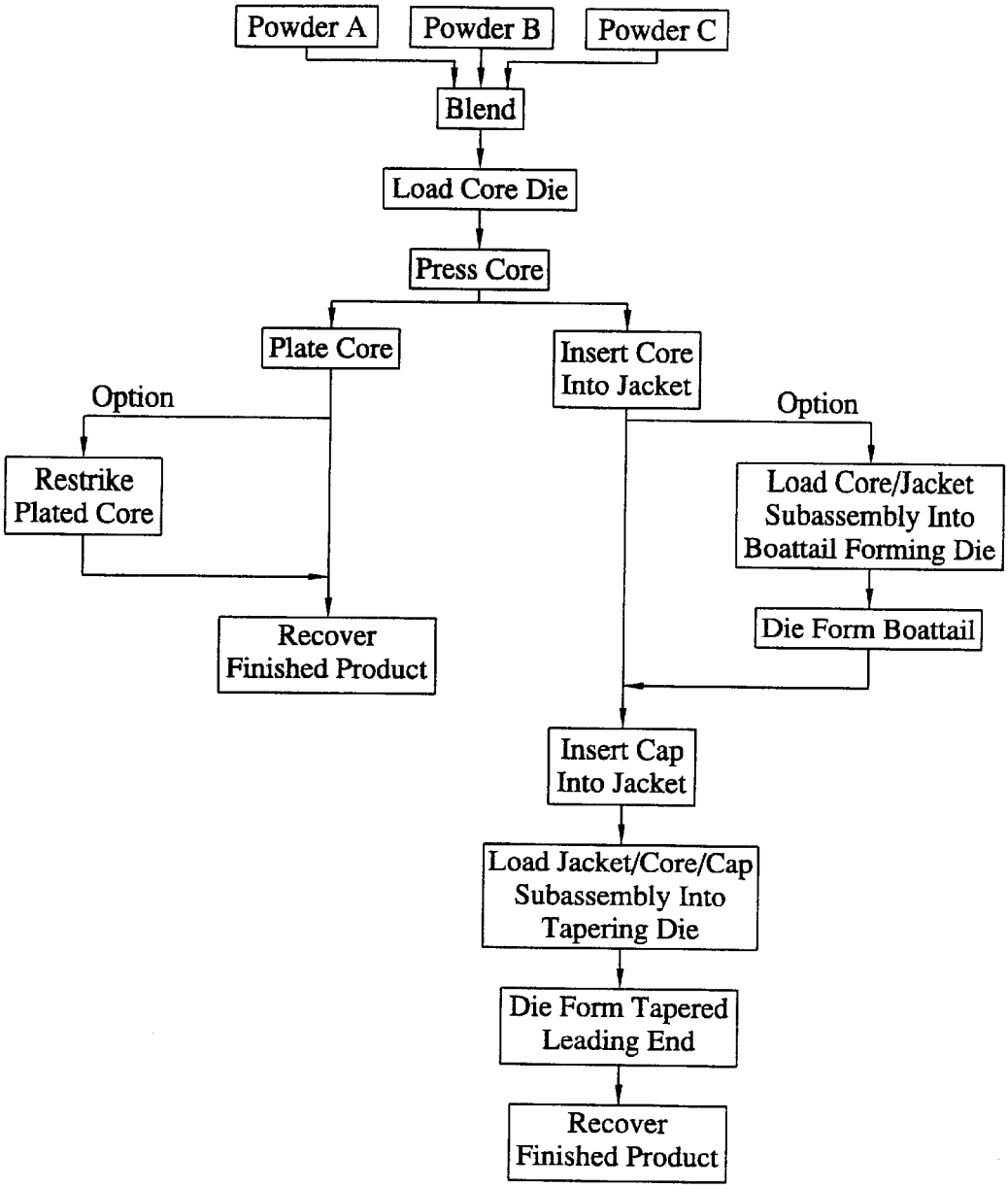
FIG. 1 is a flow sheet of one embodiment of the method of the present invention.
Figure 2:
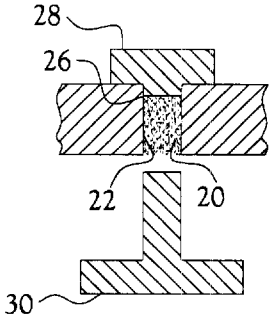
FIGS. 2, 3 and 4 are representations, in section, of three steps of a process for die-forming a compact of a mixture of powders in accordance with the present invention, including the step of loading a mixture of powders into a die (FIG. 2), cold-pressing the powder mixture within the die cavity into a self-supporting compact (FIG. 3) and removal of the pressed compact from the die (FIG. 4)
Figure 3:
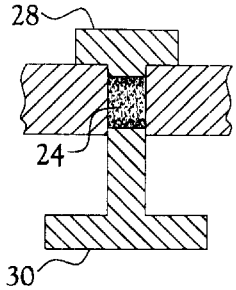
Figure 4:
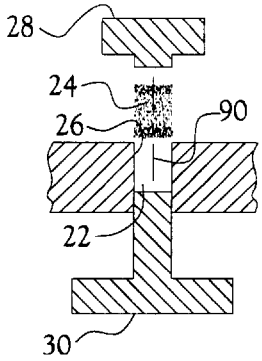

With reference to FIG. 1, in one embodiment of the method of the present invention, there are selected a heavy metal powder, a light metal powder, and a non-metal matrix powder. These powders are blended together, the blending generating a powder mixture in which the metal powders and the matrix powder are substantially uniformly distributed throughout the mixture, and wherein the powders of the mixture, especially the metal powders, do not separate into layers as the mixture is handled and/or stored. Referring also to FIGS. 2–4, a portion of the blended mixture 20 is subsequently introduced into a die cavity 22. No material alteration of the uniformity of distribution of the several powders throughout the mixture occurs during this step of loading the die cavity.

The powder mixture 20 in the die cavity is compressed into a compact 24 at about room temperature employing uniaxially applied pressure sufficient to form a self-supporting compact. FIGS. 2–4 depict a die having a straight cylindrical cavity 22. The top end 26 of the cavity is closed by a first movable die platen 28 and the die cavity is filled with powder mixture 20. Thereupon the powder mixture is compressed by a second movable die platen 30 as is well understood in the art. After the powder mixture has been compacted into a self-supporting compact 24, the first die platen 28 is moved out of its position of closure of the top end of the die cavity and the compact is ejected from the die, either by moving the second die platen 30 further into the die cavity, or by means of an ejection pin (not shown).

Figure 5:
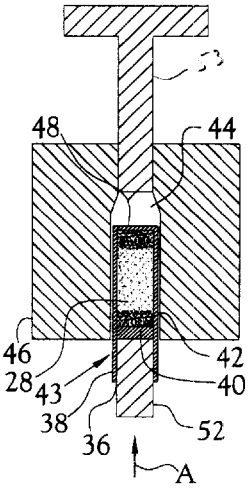
FIG. 5 is a representation, in section, of the step of die-forming a boattail on the trailing end of a jacketed core.

With reference to FIG. 5, in accordance with one aspect of the present invention, optionally, a compact 28 of the type formed by the above described procedure is inserted into the open end 36 of a thin-walled metal jacket 38. In a preferred embodiment, a thin metal disc 40 is also inserted into the open end of the jacket and disposed in engagement with the end 42 of the compact. This combination indicated generally by the numeral 43, is inserted into the cavity 44 of a die 46 with the closed end 48 of the jacket disposed most inwardly of the die cavity. The depicted die cavity 44 is designed to form a boattail 50 on the trailing closed end 48 of the jacketed/compact combination. Formation of this boattail is accomplished by applying a uniaxial pressure (arrow A) against the cap 40 and the compact 28 employing a die punch 52. The formed compact is ejected from the die as by an ejector pin 53. A jacketed compact (core) 43 having a boattail 50 formed on the trailing end thereof is depicted in FIG. 6.

Figure 6:
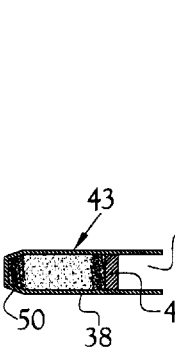
FIG. 6 is a representation, in section, of a jacketed core having a boattail die formed on the trailing end thereof.
Figure 7:
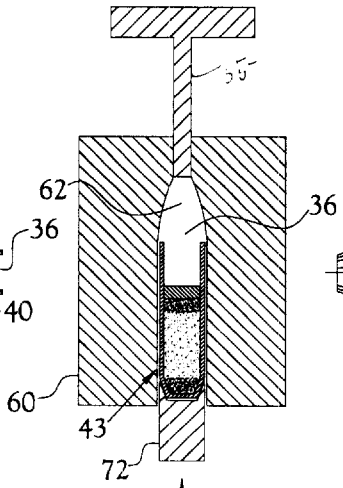
FIG. 7 is a representation, in section, of a die-forming step which forms an ogive on the leading end of a jacketed core in accordance with one optional step in one embodiment of the method of the present invention.
Figure 8:
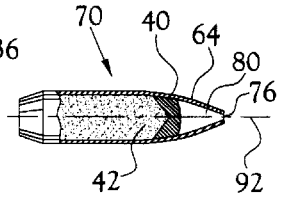
FIG. 8 is a side elevation view, partly cutaway, of a projectile manufactured in accordance with the method of the present invention.
Figure 9:
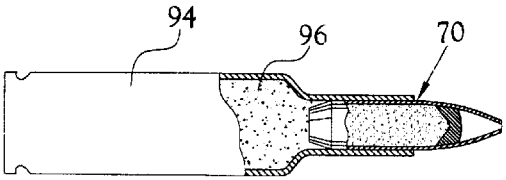
FIG. 9 is a side elevation view, partly cutaway, of a gun ammunition cartridge having incorporated therein a projectile of the type depicted in FIG. 8.

Referring to FIGS. 7 and 8, in accordance with a further aspect of the present invention, the jacketed core depicted in FIG. 6, with or without a boattail formed on the trailing end thereof, is inserted into a further die 60 having a die cavity 62 designed to close the open end 36 of the jacket and simultaneously form an ogive 64 (see FIG. 8) on the leading end 66 of the projectile 70. In the schematic representation of FIG. 7, the jacketed core 43 is compressed within the die 60 by means of uniaxially applied pressure employing a die punch 72. The formed projectile may be ejected from the die cavity as by an ejector pin 55.

As depicted in FIG. 8, in the die forming operation depicted in FIG. 7, the open end of the jacket is formed into an ogive 64, but the leading end 74 of the jacket (projectile) is not completely closed, leaving an opening 76 which extends from the exterior into the interior of the jacket of the projectile. Further, the die forming operation depicted in FIG. 7 deforms the end 42 of the core and the cap 40 into a portion of the ogive. In the depicted projectile, that portion of the leading end of the jacket which is not occupied by either the cap or a the core defines a meplat cavity 80. This cavity is in communication with the opening 76 in the leading end of the projectile. optionally, the operation of closing the open end of the jacket may be designed to so deform the cap and core as to substantially fill the jacket, in which instance no meplat cavity would be formed. As desired, in this optional embodiment, there may be formed a depression in the leading end of the projectile.

The projectile of the present invention may be incorporated into a standard gun ammunition cartridge 94 containing a powder charge 96.

Full frangibility of a projectile immediately upon the projectile striking a target other than a solid target is undesirable in most shooting circumstances, especially where some degree of penetration of the target is desired before disintegration of the projectile. Rather, it has been found by the present inventor that, when the target is other than a solid target, the terminal ballistics of a frangible projectile may be optimized when the projectile remains intact for a time sufficient to at least partially penetrate a target and full frangibility occurs following this initial penetration, or in some circumstances, following full penetration and exiting the target. To achieve initial penetration, the present inventor has discovered that the projectile must be of sufficient strength to withstand the initial impact with the target, but not so strong as to preclude the desired subsequent full disintegration of the projectile. To this end, the projectiles of the present invention include a core which is fabricated from a core combination of a heavy metal powder, a light metal powder and a non-metal matrix powder. Further, the degree of penetration before full disintegration of the core of the projectile occurs, after the projectile has struck a given target, is selectable for a given core weight and powder composition by controlling the timing and extent of disintegration of the light metal covering of the core. In the instance when the core is formed and then inserted into a light metal jacket via the open end of the jacket, the open end of the jacket becomes the leading end of the completed projectile. When inserting a right cylindrical core into a jacket and the leading end of the jacket and core combination is die formed to define an ogive or rounded end on the leading end of the projectile, the core is partially deformed into the ogive. Depending in part upon the value of the ogive (X times the diameter of the jacket equals the length of the ogive, which resultant is employed as a designation of the ogive, e.g. an eight ogive has a length 8 times the diameter of the jacket), the die forming operation will not fully close the leading end of the jacket and further may result in the formation of a meplat cavity adjacent the leading end of the projectile. The unclosed portion of the leading end of the jacket defines an opening that leads into the meplat cavity interiorly of the jacket. The size of this meplat cavity is also a function of the value of the ogive for a given caliber projectile. Still further, the extent to which the core is deformed and forced into the ogive of the projectile during the die forming of the ogive is a function of the length of the core which is inserted into a jacket of a given length of internal cavity. The present inventor has found that through selection of the volume of the meplat cavity remaining after formation of the ogive of the projectile and the diameter of the opening in the leading end of the jacket that communicates with the meplat cavity, it is possible to select the timing of the commencement of disintegration of the covering for the core, hence select the timing of the commencement of disintegration of the powder-based core of the projectile, upon the projectile striking a given target. Still further, through selection of the volume of the meplat cavity and the diameter of the opening in the leading end of the jacket, it is also possible to provide a projectile which will penetrate and disintegrate more or less in a given type of target, e.g., animal tissue versus steel plate.

Whereas the exact mechanism by which the matrix powder functions within the present method is not known, it appears that the matrix powder has an affinity for the metal powders when the heavy metal powders and the matrix powder are mixed in the dry state. This affinity appears to extend to both the heavy metal powder particles and to the light metal particles, apparently indiscriminately. This affinity is evidenced by the fact that blending of the several powders results in a blended mixture of powders in which there is enhanced flowability, yet little, if any, tendency of the metal powders to separate into layers. The matrix powder of the present invention appears to function in the nature of temporary agglomeration sites for the smaller particles of the metal powders. In this respect it appears that the individual particles of the fractions of smaller metal powder particle sizes are attracted in some manner to the matrix powder particles (or vice versa) at least to the extent that multiple ones of the smaller metal powder particles agglomerate with the matrix powder particles. This action appears to render the particle sizes of all the powders more nearly the same size with the result that the powder mixture does not separate into layers or regions of heavy metal powder or light metal powder, hence the mixture blends well and tends to remain blended during transfer from a blending station and to its ultimate loading into a die cavity and exhibits enhanced flowability which provides enhanced production rates, greater accuracy in the filling of the forming die, and enhanced die-fill ratios.

Thus, as the blended powder mixture is transferred from a blender, for example, to a storage container, thence to a feeder for a die cavity, thence into a die cavity, the powder mixture flows readily and remains in its well-blended state. This action has been further found to assure that there is uniformity of distribution of the metal powders in the die cavity, hence a resultant compact having uniform density, at least in a direction radially of the direction of the uniaxially applied pressure within the die cavity. As noted, this unexpected excellent flowability increases both the controllability of the quantity of the powder mixture which is added to a die cavity, and the speed with which the die cavity can be loaded. Further, the present inventor readily achieves die cavity fill ratios of substantially 2 to 1, thereby minimizing the extent of the stroke length of a die punch which is used to compact the powder mixture within the die cavity when compacting the powder mixture to a target strength for a given size compact.

Moveover, it further appears that the desirable effects of the matrix powder particles, in combination with the metal powders, carry over into the compact, but, in the compact, the matrix powder appears to function as a separator for the metal powder particles. For example, this effect is evidenced by the observed magnitude of the frangibility of the matrix-containing compact after it has been incorporated into a projectile and fired to a target. This frangibility, for example, has been found to cause a spinning projectile to "cut" a hole through a cold-rolled steel plate, wherein the hole is approximately 150% of the diameter of the caliber of the projectile, and in other instances to fully disintegrate upon striking this same target without more than a slight depression in the surface of the target, depending in part upon the ratio of heavy metal powder to light metal powder, the percentage of matrix powder in the overall powder mixture and the physical structure of the leading end of the projectile. Thus, the matrix powder in the overall powder mixture, appears to serve at least two, and likely more, functions. First, the matrix powder present in the powder mixture which is being initially die formed into a compact, appears to serve to promote the formation of the metal powder particles into a self-supporting compact. Either too little or too much matrix powder in the powder mixture prevents the formation of a self-supporting metal powder-based compact upon cold pressing of the powder mixture in a die. Further, too little matrix powder deleteriously affects the desired frangibility of the projectile. As noted hereinabove, the matrix powder also enhances the flowability of the powder mixture with several desirable results. Second, in the course of reforming the geometry of a compact (core) into the desired geometry of a finished projectile, the matrix powder has been noted to enhance the ease with which the compact is restruck in a die, such as in the operation of inserting the compact into a metal jacket, die forming of the jacket and compact combination into a projectile having a boattail and/or a leading end having an ogive. In these latter manufacturing operations, it has been noted that the presence of the matrix powder in the compact appears (a) to allow at least portions the compact to be more readily broken down as needed to cause it to conform to the interior cavity of a restriking die (boattail or ogive formation), (b) to enhance the flow of the broken down portions of the compact into all areas of the die cavity, such as into the scored lines on the interior of a metal jacket when the compact is being inserted into the scored jacket which is, in turn, held in a constraining die, (c) to rebond the broken-down compact into a coherent element within the jacket at relatively low pressing pressures, and (d) in the finished projectile, enhancing the frangibility of the projectile when it strikes a target. Sintering or heating of the powder mixture to pyrolyze or otherwise drive off the matrix powder during the course of its formation into a compact, or of the compact after its formation, or sintering or heating of the powder mixture or compact after its initial formation are to be avoided in the present invention inasmuch as these actions have been found to destroy those characteristics of the compact of the present invention which appear to contribute to its usefulness in the present invention. In similar manner, bonding of the powder mixture into a strong compact through the use of the relatively high pressing pressures is to be avoided when seeking full frangibility of the projectile.

In accordance with one aspect of the present invention, it has been discovered that, contrary to the teachings of the prior art, full frangibility is attainable by die-forming, at about room temperature, a self-supporting compact having a low compressive strength, preferably below about 35 MPa as tested with a standard compression strength tester whose platen is moved at 0.1 inches/min. Importantly, as noted, the die-formed compact is neither heated to expel the matrix powder nor sintered. Formation of a self-supporting compact under these die-forming conditions is not known to exist in the prior art where heavy metal powders are involved, either with or without a light metal binder. Highly unexpectedly, the present inventor has discovered that tungsten metal powder, without a light metal binder, can be die-formed into a self-supporting compact employing the concepts of the present invention. "Self-supporting" as used herein refers to the die-formed compact having sufficient crush strength to withstand extraction of the compact from the die cavity and to be amenable to handling in further manufacturing operations such as insertion into a jacket, or undergoing a metallic plating operation, all with the normally accompanying physical handling of the compact. A cold pressed compact formed of tungsten metal powder and a light metal powder (e.g., lead or tin) and a non-metal matrix powder and having a compressive strength of at least about 2 MPa and preferably not greater than about 35 MPa (measured in a standard compressive strength testing device at a platen movement of 0.1 inches/min) has been found to be "self-supporting" for purposes of the present invention.

In accordance with the present invention, the selected powders are blended to form a uniform mixture thereof. A quantity of the blended mixture is measured into a cavity of a first die and cold-compacted (at about room temperature) into a compact (ie., a core blank) which commonly is of a solid straight cylindrical geometry, but in at least one embodiment may be of other than a straight cylindrical geometry, such as a compact having a cylindrical body and a tapered or rounded leading end and or a boattail. Pressures sufficiently high to develop a self-supporting compact, without sintering, heating or relatively extreme consolidation treatment of the compact such as isostatic pressing or the like, are employed. For example, pressures of less than about 10,000 psi are employed with most powder mixtures, but percentages of tungsten powder in excess of about 80%, by weight, require higher die forming pressures. The core blank (compact) so formed is sufficiently self-supporting as to permit it to be mechanically handled during subsequent manufacturing operations having a compressive strength of between about 2 MPa and about 45 MPa. The matrix powder has been found to provide the desired properties, e.g., flowability of the powder mixture, uniformity of density of the core blank, formability of the core blank during manufacturing operations, and frangibility of the resultant projectile when it strikes a target, if the matrix powder is present in the mixture in an amount of between about 0.01% and about 1.2%, by weight and preferably between about 0.09% and about 0.3%, by weight, and most preferably about 0.1%, by weight. Quantities of about 1.2%, by weight, of the matrix powder in the mixture, reduces the flowability of the powder for loading the powder into a die and. precludes the core blank from being sufficiently self-supporting as permits it to endure subsequent handling, etc., during further manufacturing operations. Quantities of less than about 0.01%, by weight, of the matrix powder has been found to be ineffective in achieving the desired characteristics of the compact and resulting projectile. Following its formation in the die cavity, the core blank of the present invention is neither sintered, nor otherwise heated to a temperature which will pyrolyze or otherwise drive off or destroy the matrix powder which desirably remains distributed throughout the compact in its original state.

In the present invention, the particle size and particle size distribution of especially the heavy metal powder and of the matrix powder have been found to be important in achieving a nonsintered, nonheated, cold-compressed, compact which will withstand subsequent manufacturing operations. Specifically, it has been found that each of the heavy metal powder and the light metal powder is to include a major portion of powder particles which are of a size smaller than about 325 mesh. Further, preferably, each of the metal powders includes a relatively small percentage of particles which are of a mesh size larger than about 325 mesh and also a relatively small percentage of particles which are of a mesh size smaller than about 325 mesh. In similar manner, the powder particles of the matrix powder, preferably, exhibit an average particle size of about 12 microns, with a relatively small portion of the matrix powder particles being of a size greater than about 12 microns. This combination of powder particle sizes, coupled with selective weight ratios of metal powder to matrix powder, within a limited range, has been found effective in producing heavy-metal-powder-based projectiles, with a light metal binder, which will exhibit a wide range of projectile performance characteristics. The present inventor's experience indicates that the metal powder particles of the smaller size portion thereof may, to a substantial extent, actually pack about the matrix powder particles, as opposed to the matrix particles filling the interstices between adjacent metal powder particles.

Further, It has been discovered that heavy metal particles having a generally rhombohedral geometry, function more effectively in the present invention, as opposed to platelet, rod-shaped or other similar geometries of the heavy metal powder particles.

DETAILED DESCRIPTION OF INVENTION

In accordance with one broad aspect of the present invention, the method comprises the steps of selecting a heavy metal powder, ie., a metal powder having a density greater than the density of lead, which includes greater than about 50% of the particles thereof of a size between about 200 mesh (45 microns) and about 400 mesh (38 microns), and which exhibit a generally rhombohedral geometry, selecting a matrix powder in the nature of a finely divided oxidized homopolymer of polyethylene having a major portion of its particles of an average size of about 12 microns, selecting a light metal powder having a density not greater than the density of lead and having a major portion of its particles of a size of about 325 mesh, blending the heavy metal powder, the light metal powder and the matrix powder into a mixture in which the various powder particles are substantially uniformity distributed throughout the mixture, introducing a quantity of the powder mixture into a die cavity, pressing the powder mixture in the die cavity at about room temperature to form a nonsintered, nonheated compact having a compressive strength of between about about 2 MPa and about 35 MPa, thereafter providing an external covering for the outer surface of the compact, the covering exhibiting lubricity properties between the covering and the bore of the barrel of a gun, thereafter, optionally, die forming the covering and compact to a desired geometry during which at least a portion of the bonds of the compact are disrupted and, optionally, reestablished, and recovering the projectile. The step of covering the compact may take the form of encapsulating the compact in a soft metal, e.g., copper, jacket or plating the compact with a soft metal (e.g., copper) plate.

In the present method, the compact most commonly is of a straight cylindrical geometry, but can be formed with one end having an ogive and/or one end having a boattail. This compact is the precursor for the core of a projectile and therefore is at times subjected to further die pressing for the purpose of reconfiguring the geometry of the compact (core). In any event, the present process provides a compact which exhibits substantially uniform density in a direction radially of the longitudinal centerline 90 of the compact, within any given plane normal to the longitudinal centerline of the compact. The density of the compact, however has been found to be greatest near each end of the cylindrical compact, with decreasing density toward that midplane which is normal to the longitudinal centerline of the compact. In the course of reconfiguring the core geometry, at least a portion of the bonds between the powder particulates of the core blank are disrupted as the compact is formed into a covered core of the desired size and geometry. The final geometry of the core may be any desired geometry for a projectile, e.g., it may include an intermediate cylindrical body portion and an ogive end, and/or a boattail.

In one embodiment, the bonds between powder particles in the core which are disturbed in the course of further die forming of one or more of the opposite ends of the core, preferably may be minimally reestablished through the choice of the pressure employed during the reconfiguration process to thereby enhance the frangibility of the core. In any event, this disruption of the powder bonds does not effect such redistribution of the powder within the core of the projectile as to materially alter the uniformity of density of the core radially of the longitudinal centerline 92 of the resulting projectile.

In a further embodiment of the present invention, the reconfiguration of the compact, without a covering, may be carried out in a die which is designed to reconfigure the compact to an undersized core having an ogive and/or a rounded nose. In this embodiment, the reconfigured core is subjected to a pressure sufficient to initially break down a sufficient quantity of the bonds between the powder particles as permits the flow of the powder particles into a conforming geometry with the die cavity employed and which is sufficient to reconsolidate the powders into a self-supporting element. This shaped, but undersized, core may thereafter be provided with a soft metal plate, such as a copper plate. This plated core, preferably, is thereafter restruck in a die having a cavity which is precisely dimensioned to the desired final size and shape of the plated projectile. In this further die-forming operation, the bonds between the powder particulates of the core may be disrupted to a limited extent. As described hereinabove, this reconfiguration may be carried out employing pressure which either reconsolidates, at least to a degree, the disrupted bonds, or produces very little, if any, reconsolidation of the bonds. Limiting reestablishment of the disrupted bonds provides for enhanced frangibility of the projectile upon its impact with a target, whereas maximum reconsolidation of the bonds increases the projectile's penetration properties, but without destruction of the desired frangibility of the core. In a preferred embodiment, the coated projectile is passed through a diameter-sizing die to assure that the projectile is of the desired diameter (caliber). Even very small deviations on the high side of the desired caliber projectile have been found to increase the resistance of the projectile to move through a gun barrel, with resultant increase in pressure build-up in the gun barrel and physical displacement of the locus of the point at which the projectile strikes a target, relative to the locus of the point at which a "true caliber" projectile strikes the target, all other conditions being the same.

In the instance where a core is initially die formed with its own tapered or rounded leading end (ogive) and thereafter is to be plated with a light metal to form the completed projectile, the core preferably is provided with a dimple or indentation in the leading end of the core. The depth and diameter of this indentation is chosen to at least partially replicate the meplat cavity and opening in the leading end of a jacket/core combination as described hereinabove.

Contrary to the known prior art, the projectiles of the present invention which include a heavy metal powder-based core that is plated with a relatively light (soft) metal, exhibit unique performance characteristics when they strike a target. Specifically, the projectiles of the present invention have been found to penetrate a soft tissue target, creating the usual channel into the target, but which will disintegrate readily as the projectile travels further into the target and/or when the projectile strikes a semi-solid or solid object such as cartilage, bone, or a wood, metal, glass or plastic associated with the primary target. The present frangible projectile will also disintegrate after penetrating animal tissue by a short distance, e.g, 1–6 inches, due to the hydrostatic shock effect. Importantly, should the projectile fully penetrate and exit the primary target, upon its first impact with a semi-solid or solid object external of the primary target, it fully disintegrates, usually harmlessly. The disintegration action, whether internally or externally of the primary target, fully involves both the core and the plated coating thereon, each of these components being dissipated over very short distances as harmless minute particulates. Ricochet is essentially eliminated with these projectiles. Should this fully frangible projectile strike some solid or semi-solid object instead of striking the intended target, the projectile resulting from this embodiment fully disintegrates upon impact with the object without ricocheting. The degree of frangibility of the fully frangible projectile is indicated by the fact that when the projectile strikes a solid or semi-solid surface such as a metal beam or the like, the projectile leaves little or no trace of visually identifiable materials from which the core is fabricated aside from a powder residue. In some instances, the point of impact with a metal beam or sheet may be evidenced by a slight depression in the surface of the solid target.

Irrespective of whether the compact is inserted into a jacket or is plated with a coating of a light metal, preferably the resultant final projectile includes a cavity opening outwardly from its leading end. As noted hereinabove, in the jacketed core projectile, this cavity takes the form of a meplat cavity internally of the jacket adjacent the leading end of the projectile plus an opening leading from the exterior to the interior of the jacket at the leading end of the projectile and communicating with the meplat cavity. In the plated core form of projectile, the cavity takes the form of a dimple or depression in the leading end of the projectile. In one embodiment, this depression is formed simultaneously with the die forming of the powder mixture into a shaped core. As desired, the diameter and/or depth of the depression may be increased by drilling away a portion of the core within the depression after the core has been die formed.

In a still further embodiment of the present invention, the die-forming of the compact (core) into a projectile is carried out after the compact has been inserted into a soft metal jacket, such as a cylindrical copper jacket which has one end thereof closed. In this embodiment, the die-forming of the compact/jacket combination serves to simultaneously cause the jacket to conform to the outer surface geometry of the core and to shape and size the core and jacket into the desired projectile. Common commercially available gun ammunition jackets are cup-shaped. They are normally formed by deep drawing of a sheet of metal, such as copper. This technique causes the wall thickness of the jacket to be relative thick nearest the closed end of the jacket and relatively thin nearest the open end of the jacket. When inserting a straight cylindrical core into this jacket, the core is inserted into the open end of the jacket and thereafter pressed into the jacket by pressure applied uniaxially to the core through the open end of the jacket. This action serves to "seat" the core within the jacket, which in turn causes a degree of disruption of the interparticle bonding within the core, at least in the area of the core that is positioned adjacent the closed end of the jacket. Thereafter, the partially jacketed core is placed in a further die and, by means of pressure applied uniaxially to the closed end of the jacket, the open end of the jacket and that end of the core adjacent the open end of the jacket, are caused to conform to the geometry of the cavity of the further die. This geometry may be in the nature of an ogive or rounded leading end of the projectile. Further, in this action, the open end of the jacket is commonly not fully closed, leaving a "hollow point" geometry for the projectile.

In the design of the meplat cavity and opening leading into the cavity, the present inventor has found that within limits, the larger the volume of the meplat cavity and/or the opening leading into the cavity from outside the projectile, the longer the metal jacket or plate remains intact, and the deeper the projectile will penetrate a given target before full disintegration of the powder-based core occurs. In this respect, by way of example, a .308 caliber projectile designed to penetrate a standard gel block by about 18 inches and thereupon fully disintegrate may be provided with a meplat cavity having a depth of about 0.325 to 0.336 inch and an opening of between about 0.150 and about 0.200 inch diameter, whereas the same projectile provided with an opening of between about 0.025 and about 0.030 inch diameter will penetrate the same gel block by about 4 inches and then fully disintegrate. Other combinations of meplat cavity volume and opening diameters may be employed to obtain other timing of the full disintegration of the core following the initial impact with disintegration of the powder-based core being a function of the time required to strip away the outer jacket or plate covering of the core following the initial impact with the target. Even though this time delay is in the nanosecond range, it is nevertheless of importance in obtaining the desired terminal ballistics of the projectiles of the present invention.

A preferred tungsten metal powder for use in the present invention is that available from Osram Sylvania Products, Inc. of Towanda, Pa. and identified as M70. A typical particle size distribution of this powder is as follows:

TABLE I

| Seive Size | Percentage | Micron Size |
|---|---|---|
| +140 | 3.5% | >160 microns |
| −140 +200 | 12.7% | 75 to 160 microns |
| −200 +325 | 32.0% | 45 to 75 microns |
| −325 +400 | 11.0% | 38 to 45 microns |
| −400 | 41.0% | <38 microns |

Notably, almost 90% of these powder particles are less than 200 mesh and a major portion (about 52%) of the powder particles of this powder are between about 325 mesh and about 400 mesh in size. The individual particles of this powder are generally rhombohedral in geometry and, when combined with a matrix powder and a light metal powder, have been found to be compactable into a self-supporting compact in a straight cylindrical die cavity under uniaxially applied pressures of less than about 10,000 psi for powder mixtures containing less than about 80%, by weight, of heavy metal powder. For powder mixtures containing up to about 90%, by weight, of heavy metal powder, the pressing pressures may reach 30,00 to 50,000 psi, whereas compaction pressures for metal powder mixtures containing about 97%, by weight, of heavy metal powder can require upwards of 100,000 psi pressing pressure to obtain a self-supporting compact. The compact produced in each instance exhibits a compressive strength of between about 2 MPa and about 45 MPa. The compacts formed with these powders preferably are of a straight cylindrical geometry and are readily ejected from a tungsten carbide die employing commercially available manufacturing equipment. Attempts to press the tungsten powder alone (without a matrix powder or a light metal binder) in this same equipment were unsuccessful in that it was not possible to fabricate a self-supporting compact. Additionally, the tungsten powder, without a non-metal matrix powder added to it, tends to segregate into layers of larger particles and layers of smaller particles. Tungsten powders which exhibit a planar or near planar geometry or a near rod geometry, for example, have been found to be unacceptable for use in the present invention, as have other tungsten powders which deviate significantly from a generally rhombohedral geometry. It will be recognized that heavy metal powders suitable for use in the present invention include not only tungsten, but also depleted uranium, tantalum, and their carbides, or mixtures of these metals and their carbides.

The matrix powder of the present invention is a non-metal powder. Among other characteristics, the matrix powder exhibits an affinity for the metal powders employed in the powder mixture of the present invention. A preferred matrix powder employed in the present invention is identified as ACUMIST A-12, a finely divided oxidized homopolymer of polyethylene available from Allied Signal Advanced Materials of Morristown, N.J. The powder particles of this matrix powder are substantially uniform in size and shape, have an average particle size of about 12 microns, and a major portion of the powder particles being 325 mesh size. Whereas the mechanism(s) by which this matrix powder contributes to the formation of a self-supporting cold-pressed compact is not known with certainty, it has been found that the same polyethylene powder having a particle size substantially greater than about 325 mesh or substantially less than about 325 mesh fails to combine with the aforedescribed heavy metal powder and/or the light metal powder, when present, in a manner which will permit the formation of a self-supporting compact which will exhibit frangibility when incorporated into a projectile for gun ammunition. It is believed, however, that the combination of particle sizes and particle size distributions of the metal powders and polyethylene powders in some manner enhances the stability of distribution of the smaller powder particles of the metal powders throughout the powder mixture. This, in turn, appears to result in enhanced compacting of the metal powder particles, possibly due to the more uniform distribution of the smaller metal powder particles throughout the powder mixture. In this respect, it has been noted that the density of the compact produced by the present method is unusually uniform in density in a direction radially of the longitudinal centerline and within a plane that is oriented normal to the longitudinal centerline of the cylindrical compact. This factor is important with respect to the spin stability of the projectile during its free flight when fired from a gun having a rifled barrel. Successful fabrication of compacts employing tungsten metal powder of mesh sizes approaching predominately 150 to 200 mesh, or larger, particles has not been found to be possible, employing the concepts of the present invention.

The quantity of matrix powder included in the powder mixture of the present invention is almost minuscule, when expressed in weight percent, ranging between about 0.01%, by weight, and about 1.2%, by weight. The density of the preferred matrix powder is about 0.99 gm/cc. The density of the tungsten powder is 19.3 gm/cc. Thus, it will be recognized that the volume of matrix powder employed in a preferred powder mixture is relatively large, as opposed to its relatively small weight percentage. This factor emphasizes the function of the matrix powder as a separator for the metal powder particles in the powder mixture. Further, in view of the somewhat close similarity in particle size of the metal powders and the matrix powder, it would appear that there is some form of synergism between these powder particles which produces the observed flowability of the powder mixture, as the powder mixture is initially introduced into a die, and in the course of the initial and subsequent pressing of the powder mixture disposed within a die. That is, the matrix powder appears to function in combination with the metal powders, in proper proportions, to produce a compact which is sufficiently strong to undergo further mechanical manufacturing operations, even though one might expect the matrix powder to reduce or interfere with the bonding of the heavy metal powder particles to one another during pressing in the die. Most notably, this desired compaction of the powder mixture is achieved at relatively low compaction pressure, such as less than about 10,000 psi for tungsten/binder metal/matrix powder combinations in which the tungsten is present in an amount of up to about 80%, by weight, of the powder mixture. In any event, it is of importance that the matrix powder remain in the compact, as opposed to it being pyrolyzed or otherwise converted or expelled from the compact.

As noted, the continued presence of the matrix powder in the finished projectile materially contributes to the frangibility of the projectile when it strikes a target as noted in the Examples provided herein. Specifically, projectiles of the present invention have consistently proven to be exceptionally accurate and even more exceptional as respects their terminal ballistics.

It is taught in U.S. Pat. No. 5,594,186 that several organic compounds, including ethylene bis-steramide, a $C_{12}$–$C_{20}$ fatty acid, like stearic acid, a paraffin, a synthetic wax, a natural wax, a polyethylene, a fatty diester, a fatty diamide, and mixtures thereof may be used as a die lubricant. This patent further lists "Salts of organic acids, like zinc, lithium, nickel, iron, copper, or magnesium stearate" as suitable die lubricants It is also taught in this patent and is also in the art, that die lubricants are to be removed from the compact by heating or sintering of the compact. Contrariwise, in the present invention, it does not appear that the matrix powder, even though it be a polyethylene, performs materially as a die lubricant. Rather, the matrix powder appears to function in the nature of a "leveler" of the particle sizes of the metal powders, thereby enhancing flowability and reducing "layering" of the metal powder particles before the powder mixture is placed in a die, and as the powder mixture is being placed in a die. Moreover, this matrix is purposely retained in the compact where it appears to serve as a limiter of the bonding to one another of the particles of the metal powders, particularly tungsten metal powder, and thereby enhances the frangibility of the resulting projectile. In this respect, it is important in the present invention that neither the compact, nor the projectile, be subjected to sintering conditions or to heat above about the pyrolyzation or vaporization temperature of the matrix powder. These latter factors are of further importance in that the prior art teaches that powder mixtures are to be sintered or subjected to other unusual treatment of the compact such as isostatic pressing at ultra high pressures in order to obtain a desirable compact. Such other treatments are unduly time consuming and/or economically impractical in the manufacture of gun ammunition and are to be avoided in the present invention.

In the present invention, the preferred light metal powder has a density not greater than the density of lead. Acceptable light metal powders include lead, tin, zinc, bismuth, aluminum, magnesium, and like light metals, most preferably lead or tin. One particularly useful lead powder is identified as PB-100 lead powder available from Atlantic Equipment Engineers of Berginfield, N.J. This powder has a predominate particle size of about 325 mesh or less. Tin powder identified as 5754 tin powder available from ACU-POWDER International, LLC of Union, N.J. has been found suitable for use as a light metal in the present invention. About 20% of this powder is less than about 325 mesh and about 80% is of a mesh size between about 200 and about 325 mesh.

In one embodiment of the present method for use in the manufacture of a fully frangible projectile of .308 caliber diameter, weighing 253 grains and employing 80% tungsten as the heavy metal powder, 20% lead as a light metal powder and 0.1% ACUMIST A-12 as a matrix powder, all percentages by weight, a quantity of the powder mixture sufficient to fill a straight cylindrical die cavity of 0.257 inch diameter to a depth of 1.0 inch was introduced into the die cavity. The powder mixture in the die was uniaxially pressed at about 9510 psi into a self-supporting compact. The pressed compact was ejected from the die and placed in a copper jacket having a wall thickness of 0.012 inch. The open end of the jacket was positioned in a die having a tapered cavity designed to form a 12 ogive projectile, and the jacket/core combination was pressed into the tapered die at a pressure sufficient to form an ogive leading end of the projectile. This ogive-forming activity left a small meplat cavity adjacent the leading end of the projectile and an opening of 0.030 inch diameter leading from the exterior of the projectile into the meplat cavity. When this projectile was fired into a standard gel block, the projectile penetrated the gel block and fully disintegrated over a distance of about 15 inches in the form of a generally cone-shaped dispersion pattern, the major diameter of which was about 8 inches.

EXAMPLE I

In one example of the method of the present invention, a 30 caliber projectile was manufactured employing a mixture of about 60%, by weight, of tungsten metal powder having a predominate particle size of less than about 325 mesh, about 40%, by weight, of tin powder having a predominate particle size of about 325 mesh, and about 0.1%, by weight, of an oxidized fine particle size polyethylene powder having a mesh size of about 325 mesh or less. A quantity of this mixture was introduced into a die employing a die fill ratio of substantially 2 to 1. Within the die, the powder was pressed at room temperature at a pressure of about 5940 psi to form a compact of a straight cylindrical geometry having a compression strength of 3.5 Mpa. This compact was placed in a commercial copper jacket designed for a 30 caliber projectile. This jacket and core combination was placed in a right cylindrical die and the core was seated in the jacket. The combination was thereafter placed in a die having an ogive-shaped cavity, the open end of the jacket being oriented toward the apex of the ogive cavity, and pressed at room temperature with a pressure sufficient to cause the jacket and core to conform to the ogive cavity, leaving a small opening at the leading end of the projectile. The completed projectile weighed 253 grains. Multiple ones of these projectiles were formed, loaded into cartridges and subsequently fired from a 30 caliber rifle at various targets. In all instances, the projectiles exhibited excellent shot patterns (groupings of individual shots), specifically consistent shot patterns of less than 10 inches diameter at 1600 yards.

EXAMPLE II

In a further example, a 5.56 mm projectile weighing 87 grains was prepared employing the same tungsten, tin and polyethylene powders and procedures as in Example I, but with the tungsten being present in an amount of 83%, by weight, the tin being present in an amount of 17%, by weight, and the polyethylene being present in an amount of 0.1%, by weight.

EXAMPLE III

A 5.56 mm projectile weighing 103 grains was prepared employing the same powders and procedures as in Example I, but with the powder mixture comprising 97%, by weight, of tungsten, 3%, by weight, of lead, and 0.1%, by weight of polyethylene.

The projectiles of Examples II and III were each provided with a 12 ogive and a 7.5% boattail. Cartridges containing these projectiles were fired from semi-automatic and bolt rifles and from a machine gun. The 87 grain projectiles exhibited a ballistic coefficient of 450 and the 103 grain projectiles exhibited a ballistic coefficient of 560. The heavier projectiles were slightly more accurate than the 87 grain projectiles when fired from the same gun at the same target distances, these heavier projectiles exhibiting enhanced spin stability. All these projectiles were fully frangibile.

Compression strengths of various nonsintered compact cores prepared in accordance with the present invention are presented in the following TABLE I. All the projectiles listed in this Table were cold-pressed at room temperature in a tungsten carbide die having a straight cylindrical die cavity. Uniaxial pressing pressure was applied parallel to the length dimension of the die cavity. The compacts so produced were not treated in any manner between the time of their recovery from the die and their testing for compressive strength. The compressive strength values given were obtained employing a platen movement rate of 0.1 inches/min.

TABLE II

| Heavy Metal (by wt.)* | Light Metal (by wt.)* | Matrix Powder (by wt.)* | Pressing Pressure (psi) | Compressive Strength (MPa) | Core Weight (grains) | Core Diameter (inch) |
|---|---|---|---|---|---|---|
| 50% W | 50% Sn | 0.1% Ac** | 4220 | 3.4 | 49.4 | .257 |
| 60% W | 40% Sn | 1.0% Ac | 3420 | 2.7 | 43.2 | .257 |
| 60% W | 40% Sn | 0.1% Ac | 5940 | 3.5 | 52.5 | .257 |
| 80% W | 20% Pb | 0.1% Ac | 19780 | 3.0 | 80.0 | .257 |
| 97% W | 3% Pb | 0.1% Ac | 131580 | 31.5 | 74.1 | .257 |
| 97% W | 3% Sn | 0.1% Ac | 124180 | 22.4 | 72.5 | .257 |

*percentages are rounded and do not equal 100%
**ACUMIST 12

From Table II it will be noted that all of the listed combinations of powders produced compacts which exhibited a compressive strength of at least about 2 Mpa. Further, it will be noted from Table II that increasing the percentage, by weight, of the polyethylene powder from 0.1% to 1.0% decreased the compressive strength of the compact for a given combination of powders by about one-half.

The powder combinations of Table I have been employed in the manufacture of projectiles of various calibers in which the compact was either jacketed or provided with a thin plated covering. All of these projectiles were fully frangible upon striking a solid or semi-solid target at an angle of about 90 degrees, ie., the projectile path was substantially normal to the plane of the target. When fired from a weapon having a rifled barrel and into a target of ¼ inch thick cold rolled steel, the projectiles normally penetrated the steel, generating a hole that was approximately 50% greater than the diameter of the projectile. However, upon exiting the steel plate, the projectile substantially immediately disintegrated into harmless powder particles. In one example, 5.56 mm projectiles, made in accordance with the present invention and weighing 76 grains were fired into a ¼ inch thick cold rolled steel plate, fully penetrated the target but made no mark on a cardboard placed about 3.5 inches behind the steel target. These same type projectiles were caused to strike the steel target at an angle of about 45 degrees. These projectiles fully disintegrated upon striking the target, did not penetrate the target, but the powder content of the projectile fanned out in the form of a thin layer of powder particles which retained sufficient velocity to substantially penetrate into a wood target support which was positioned about 6 inches from the point of impact of the projectile with the target. When fired into a gel block these projectiles fully disintegrated and spread laterally in a generally conical pattern. In a further example, .308 caliber projectiles, weighing 200 grains and made in accordance with the present invention were fired at the same targets as the 5.56 mm projectiles referenced hereinabove. The .308 projectiles also fully penetrated the steel target and fully disintegrated within about 6 inches of the target. These .308 projectiles were caused to strike the metal target at an angle of about 45 degrees. Under these conditions, the projectiles did not penetrate the steel target, but disintegrated at the surface thereof and fanned out into a relatively flat pattern that laid along the surface of the target and with sufficient velocity to penetrate a wood target support located about 24 inches from the point of impact with the target. When the .308 projectiles were fired into a gel block, these projectiles penetrated the gel block, fully disintegrated and spread laterally by about 8 inches in a generally conical pattern, creating almost complete destruction of the interior of the gel block.

The following TABLE III presents other examples of the terminal ballistics of projectiles produced employing the concepts of the present invention:

TABLE III

| Caliber | Weight (grains) | Velocity (fps) | Gel Block Penetration* (inches) |
|---|---|---|---|
| 5.56 mm | 76 | 2000 | 10 (4.5" dia. spread) |
| 5.56 | 87 | 2750 | 12 (5.0" dia. spread) |
| 30 Mag | 200 | 3050 | 15 (8" dia. spread) |
| 30 Mag | 253 | 2700 | 15 (8" dia. spread) |
| 308 NATO | 200 | 2500 | 13 (about 8" dia. spread) |

*10% gel block 17" long, 11" high and 9" wide, weigh 75 lbs

In the present disclosure, the measure of each of the heavy metal powder, the light metal powder and the non-metal matrix is calculated by determining the total weight of metal powder to be prepared, and then combining the respective percentages of the heavy and light metal powders. For example, to prepare ten pounds of mixture having a 60% tungsten and 40% tin mix, one would add together eight pounds of tungsten and 4 pounds of tin powders. Thereafter, the non-metal matrix powder is added as a percentage of the total weight (ten pounds) of the metal powders, for example, 0.1%, by weight, of the matrix powder (0.1 pound of matrix powder)

Whereas the present invention has been described in specific terms in certain portions of the present description, it is intended that the invention be limited only as set forth in the claims appended hereto.

What is claimed:

1. A method for the manufacture of a frangible core for a projectile of a small bore gun ammunition comprising the steps of blending into a dry blended powder mixture at least a heavy metal powder having a major portion of the powder particles thereof of a size less that about 325 mesh, a light metal powder having a major portion of the powder particles thereof of a size less than about 325 mesh, and a non-metal matrix powder, the particles thereof having an average particle size of about 12 microns, said matrix powder being present in the mixture in an amount of between about 0.01% and about 1.2%, by weight, whereby said particles of said metal powders and said particles of said matrix powder are substantially uniformly distributed throughout said blended dry blended powder mixture as discrete individual particles, introducing a quantity of said dry blended powder mixture into a die cavity, compacting said dry blended powder mixture in said dir cavity at about room temperature employing a pressure sufficient to produce a non-sintered self-supporting core.

2. The method of claim 1 and including the step of encasing said core in a metal covering which exhibits lubricity between said metal covering and the interior of the barrel of the gun from which said projectile is to be fired and the step of subjecting said core and its metal covering, in a die, to a pressure sufficient to disrupt a portion of the interparticle bonds of the powders of the core and thereby reshaping the core, and thereafter shaping said core in said covering to a pressure sufficient to effect rebonding of at least a portion of those interparticle bonds which have been disrupted.

3. The method of claim 2 wherein said step of encasing said core in a metal covering comprises the steps of selecting a metal jacket having an open end, introducing said core into said jacket through said open end, applying uniaxial pressure to said core within said open-ended jacket with a pressure sufficient to cause said core to conform to the internal geometry of said jacket.

4. The method of claim 3 including the steps of introducing said jacket and said core contained therein into a die cavity having a internal geometry to which it is desired that said core and jacket conform, pressing said jacket and compact in said die cavity at about room temperature with a uniaxial pressure applied to said core said pressure being sufficient to cause said jacket and said core to conform to the internal geometry of said die cavity and to partially, but not completely, close said open end of said jacket.

5. The method of claim 4 wherein said core includes a longitudinal centerline and said step of cold pressing said jacket and said core does not materially alter the uniformity of the density distribution of said core radially of the longitudinal centerline of the core and within a plane normal to the longitudinal centerline of the core.

6. The method of claim 4 wherein said die cavity defines an ogive portion of a projectile.

7. The method of claim 2 wherein said core is of a size in substantially all dimensions that is less than the desired final size of said core in substantially all dimensions and wherein said core includes a longitudinal centerline and said step of encasing said core in a metal covering comprises the step of plating a metal plate onto the exterior surface of said core.

8. The method of claim 7 wherein said metal plate is copper.

9. The method of claim 1 wherein said heavy metal powder is tungsten metal powder.

10. The method of claim 9 wherein said tungsten metal powder is present in said powder mixture at between about 20% and about 97%, by weight of said powder mixture.

11. The method of claim 1 wherein said matrix powder is a finely divided oxidized homopolymer of polyethylene.

12. The method of claim 11 wherein said light metal powder comprises lead, tin, zinc, bismuth, iron, aluminum or magnesium.

13. The method of claim 12 wherein said light metal powder is present in said mixture in an amount of between about 3% and about 80%, by weight, of said powder mixture.

14. The method of claim 1 wherein said matrix powder is present in an amount of between about 0.01% and about 1.2%, by weight of the powder mixture.

15. The method of claim 1 wherein said mixture of powders resists separation of the heavy metal powder particles and the light metal powder particles into visually identifiable layers in the course of handling of the mixture following its formation.

16. The method of claim 1 wherein said self-supporting compact exhibits a compressive strength not greater than about 35 Mpa.

17. The method of claim 1 and including the step of incorporating said core into a projectile for gun ammunition.

18. The method of claim 17 wherein said step of encasing said core in a metal covering comprises the steps of selecting a metal jacket having an open end, introducing said core into said jacket through said open end, applying uniaxial pressure to said core within said jacket with a pressure sufficient to cause said core to conform to the internal geometry of said jacket, and incompletely closing said open end of said jacket to encapsulate said core within said jacket, said steps being carried out in a manner wherein said core and its metal covering, in a die, are subjected to a pressure sufficient to disrupt a portion of the interparticle bonds of the powders of the core and thereby reshaping the core, and thereafter subjecting said core in said covering to a pressure sufficient to effect rebonding of at least a portion of those interparticle bonds which have been disrupted.

19. The method of claim 18 wherein the step of closing said open end of said jacket includes the steps of introducing said jacket and said core contained therein into a die cavity having an internal geometry to which it is desired that said projectile conform, cold-pressing said jacket and core in said die cavity with a uniaxial pressure applied to said core, said pressure being sufficient to cause said jacket and core to conform to the internal geometry of said die cavity.

20. The method of claim 18 wherein said step of closing said open end of said jacket results in the formation of a void meplat cavity adjacent the leading end of the projectile and substantial, but not complete, closing of said open end of said jacket.

21. The method of claim 19 wherein said die cavity defines an ogive portion of a projectile.

22. A method for the manufacture of a core for a projectile for small bore gun ammunition comprising the steps of selecting a heavy metal powder having a major portion of the powder particles thereof of a size less than about 325 mesh, said powder particles having a substantially rhombohedral geometry, selecting a light metal powder having a major portion of the powder particles thereof of a size less than about 325 mesh, selecting a non-metal matrix powder having a major portion of the powder particles thereof of a size of less than about 325 mesh and a density of less than about 1.0 g/cc, blending between about 0.01% and about 1.2%, by weight, of said matrix powder with between about 20% and 97%, by weight, of said heavy metal powder and between about 3% and 80%, by weight, of said light metal powder, in a dry form, to form a flowable powder mixture in which the metal powder particles do not substantially separate into layers within the mixture.

23. The method of claim 22 wherein said core is of a size in substantially all dimensions that is less than the desired final size of said core in substantially all dimensions and wherein the step of encasing said core in a metal covering comprises the step of plating a metal plate onto the exterior surface of said core.

24. The method of claim 22 wherein said heavy metal powder is tungsten metal powder.

25. The method of claim 22 wherein said matrix powder is a finely divided oxidized homopolymer of polyethylene.

26. The method of claim 22 wherein said light metal powder comprises lead, tin, zinc, bismuth, iron, aluminum or magnesium.

27. The method of claim 22 and including the step of encasing said core in a metal covering to define a projectile, said metal covering exhibiting a lubricity characteristic between said metal covering and the interior of the barrel of the fun from which said projectile is to be fired.

28. A fully frangible core for a projectile for a weapon comprising a first metal powder selected from tungsten, uranium, tantalum, and carbides, alloys, and mixtures thereof, substantially all of the particles of said first powder being of a particle size wherein said particles will pass through a 40 mesh sieve, and a major portion thereof will pass through a 325 mesh sieve, a second metal powder selected from tin, zinc, lead, bismuth, iron, aluminum or magnesium or mixtures or alloys thereof, substantially all of the particles of said second powder being of a particle size wherein said particles will pass through a 40 mesh sieve, and a major portion thereof will pass through a 325 mesh sieve, a third powder comprising an organic polymer which is characterized by an oxidized polyethylene homopolymer powder having an average particle size of about 12 microns, with a major portion of the powder particles thereof passing through a 325 mesh sieve, said third powder having a density of less than about 1 gm/cc and being present in an amount of between about 0.01%, by weight, and about 1.2%, by weight, said first, second and third powders being blended together, in a dry state, and thereafter compacted at about room temperature in a die into a non-sintered self-supporting core having particulates of said first powder exposed on the exterior surface thereof.

29. The core of claim 28 and including a layer of a material which is capable of functioning as a lubricant between the projectile and the barrel of a weapon from which the core, when incorporated into a projectile, is to be fired, substantially uniformly encompassing essentially all of the exterior surface of said core.

30. A method of manufacture of a frangible core for a projectile of a small bore gun round of ammunition comprising the steps of introducing into a blender a dry heavy metal powder having a major portion of the powder particles thereof of a size less that about 325 mesh, the individual powder particles being present as individual discrete particles, introducing into said blender a dry light metal powder having a major portion of the powder particles thereof of a size less than about 325 mesh, the individual powder particles being present as individual discrete particles, introducing into said blender a dry non-metal matrix powder, the particles thereof having an average particle size of about 12 microns, said matrix powder being present in the mixture in an amount of between about 0.01% and about 1.2%, by weight, the individual powder particles being present as individual discrete particles, blending said metal powders and said non-metal powder to produce a flowable mixture thereof wherein the individual discrete particles of each of said metal powders and said non-metal powder are uniformly distributed throughout the mixture without visibly discernable gradations between said heavy metal powder particles and said light metal powder particles within said mixture, while maintaining said uniform distribution of said metal powders within said mixture, transferring portions of said mixture into one or more die cavities, each having a longitudinal centerline, at substantially room temperature, applying substantial uniaxial pressure in the direction of said longitudinal centerline of said one or more die cavities to thereby compress said mixture within said one or more die cavities with a pressure sufficient to produce within each die cavity a self-supporting core containing said metal powders and said non-metal powder as discrete individual particles.

31. The method of claim 30 wherein said core is of a substantially cylindrical geometry.

32. The method of claim 30 wherein said transfer of said mixture into one or more die cavities comprises pouring of said mixture from a container thereof into said one or more die cavities without materially altering the uniformity of distribution of said metal powders throughout said mixture.

33. The method of claim 30 wherein each core exhibits a compressive strength of less than about 35 MPa.

34. The method of claim 30 and including the step of introducing each core into the open end of an open-ended cup-shaped jacket having a closed end and a substantially cylindrical internal volume adjacent said closed end thereof.

35. The method of claim 34 and including the step of seating each core within said jacket whereby said core substantially fills said internal volume of said jacket adjacent the closed end of said jacket.

36. The method of claim 35 and after each core has been seated within its respective jacket, die-forming an ogive on the open end of said jacket, said formation of said ogive including the movement of a portion of the powder particles of that end of said core adjacent said open end of said jacket axially toward said open end of said jacket.

37. The method of claim 36 wherein said step of formation of said ogive substantially, but incompletely, closes said open end of said jacket, leaving a void meplat cavity at said open end of said jacket.

38. The method of claim 30 wherein said heavy metal powder is tungsten metal powder and said light metal powder is tin metal powder.

39. The method of claim 30 wherein said non-metal matrix powder is micronized polyethylene.

40. The method of claim 30 wherein said core, upon being incorporated into a projectile and the projectile being fired from a gun and striking a solid or semi-solid target, disintegrates into individual particles of a size not materially larger than the largest particle size of one of the metal powders of said mixture.

* * * * *